US005908705A

United States Patent [19]

Nguyen et al.

[11] Patent Number: 5,908,705

[45] Date of Patent: Jun. 1, 1999

[54] LASER IMAGEABLE LITHOGRAPHIC PRINTING PLATES

[75] Inventors: My T. Nguyen, Montclair, N.J.; Hui Zhu, Yonkers, N.Y.; S. Peter Pappas, West Orange, N.J.; Ken-ichi Shimazu, Briarcliff Manor, N.Y.; Robert Hallman, Palisades Park, N.J.

[73] Assignee: Kodak Polychrome Graphics, LLC, Norwalk, Conn.

[21] Appl. No.: 08/812,900

[22] Filed: Mar. 10, 1997

Related U.S. Application Data

[63] Continuation of application No. 08/494,120, Jun. 23, 1995, abandoned.

[51] Int. Cl.[6] ..... B41N 1/04; B41N 3/03

[52] U.S. Cl. ..... 428/461; 428/483; 428/500; 427/478; 427/255.6; 427/301; 427/430.1; 430/21; 430/270.1; 430/271.1; 430/275.1; 430/278.1; 430/306; 430/470; 101/457; 101/458; 101/467

[58] Field of Search ..... 428/488.1, 488.4, 428/500, 461, 483; 430/21, 270.1, 271.1, 275.1, 306, 470, 278.1; 101/457, 467, 458; 427/255.6, 430.1, 301, 478

[56] References Cited

U.S. PATENT DOCUMENTS

| | | | |
|---|---|---|---|
| 4,710,401 | 12/1987 | Warren, Jr. et al. | 427/121 |
| 5,149,826 | 9/1992 | Delabouglise et al. | 207/30 |
| 5,256,506 | 10/1993 | Ellis et al. | 430/20 |
| 5,339,737 | 8/1994 | Lewis et al. | 101/454 |
| 5,351,617 | 10/1994 | Williams et al. | 101/467 |
| 5,353,705 | 10/1994 | Lewis et al. | 101/453 |
| 5,451,485 | 9/1995 | Kaszczuk et al. | 430/201 |
| 5,487,338 | 1/1996 | Lewis et al. | 101/457 |

FOREIGN PATENT DOCUMENTS

| | | |
|---|---|---|
| 0294231 | 12/1988 | European Pat. Off. . |
| 1119012 | 5/1989 | Japan . |

OTHER PUBLICATIONS

L.S. van Dyke et al., Synthetic Metals, 51, 299–304 (1992).

Nguyen et al., "Water Soluble Conducting Copolymers of o–Aminobenzyl Alcohol and Diphenylamine–4–sulfonic Acid", Macromolecules, 1994, 27, pp. 7003–7005.

Nguyen et al., "Synthesis and Properties of Novel Water–Soluble Conducting Polyaniline Copolymers", Macromolecules, 1994 27, pp. 3625–3631.

Roncali, "Conjugated Poly(thiophenes): Synthesis Functionalization, and Applications", Chem. Rev. 1992, 92, pp. 711–738.

*Primary Examiner*—Paul J. Thibodeau
*Assistant Examiner*—D. Lawrence Tarazano
*Attorney, Agent, or Firm*—Ratner & Prestia

[57] ABSTRACT

Lithographic plate compositions and a method for their production have been discovered that are especially useful in conjunction with digitally controlled lasers to directly construct printable images on lithographic plates. The plates comprise a substrate and an ablatable polymeric coating on the substrate where the ablatable, imageable coating is prepared by in situ or solution polymerization of conjugated monomers deposited on the plate by vapor deposition or in solution. Examples of such monomers are thiophene, pyrrole and aniline.

22 Claims, No Drawings

LASER IMAGEABLE LITHOGRAPHIC PRINTING PLATES

This application is a continuation of application Ser. No. 08/494,120, filed Jun. 23, 1995, now abandoned.

FIELD OF THE INVENTION

This invention relates to novel laser imageable lithographic printing plates and to the method for their production. The invention more particularly relates to a method for imagewise exposure of the novel plates using a digitally controlled laser.

BACKGROUND OF THE INVENTION

Lithography and offset printing methods have long been combined in a compatible marriage of great convenience for the printing industry for economical, high speed, high quality image duplication in small runs and large. Known art available to the industry for image transfer to a lithographic plate is voluminous but dominated by the photographic process wherein a hydrophilic plate is treated with a photosensitive coating, exposed via a film image and developed to produce a printable, oleophilic image on the plate.

While preparing lithographic plates by photographic image transfer is relatively efficient and efficacious, it is a multi-step, indirect process of constrained flexibility. Typically, a photographically presensitized (PS) plate is prepared from a hydrophilic surface-treated aluminum. A positive or negative film image of an original hard copy is prepared and the PS plate exposed to the film image, developed, washed and made ready for print operations. Any desired changes in the film image must be made by first changing the original hard copy and repeating the photographic process; hence, the constrained flexibility. As sophisticated and useful as it is to prepare plates by photographic image transfer, the need for a lithographic plate fabricating process that obviates the above problems associated with the photographic process has long been recognized.

Clearly, it would be highly beneficial to the printing industry to directly produce a quality printable image on a plate without proceeding through a multi-step photographic process. It would also be highly efficacious if a process were developed whereby changes could be made in an original image in some predetermined manner without incurring the need to correct hard copy and repeat the photography, particularly if those changes could be made "on line". Consistent with these goals, artisans in the field of lithographic plate production have recently come to bend their efforts toward the development of a means to integrate digitally controlled image-making technology, i.e., the ubiquitous PC computer of todays world, with a means to directly convey the digital image onto a lithographic plate that will be usable for large production runs (100,000 or more copies).

Image forming by digital computer aided design of graphical material or text is well known. Electronically derived images of words or graphics presented on the CRT of a digital computer system can be edited and converted to final hard copy by direct printing with impact printers, laser printers or ink jet printers. This manner of printing or producing hard copy is extremely flexible and useful when print runs of no more than a few thousand are required but the print process is not feasible for large runs measured in the tens or hundreds of thousands of pieces. For large runs, printing by lithographic plate is still the preferred process with such plates prepared by the process of photographic image transfer.

It is known that digitized image information can be used in plate making wherein a film is made to express the image according to the image digitization and an image is formed on the plate by exposure and development. While this method augments flexibility by permitting editing of a digitized image, the method does not overcome the problems associated with the photographic image transfer method of plate fabrication.

Recently, fabrication of lithographic plates by ink jet techniques has been proposed to affect the utilization of digitally controlled lithographic plate-making. One such technique is disclosed in Japanese patent application, Kokai 62-25081. This application describes the use of an ink jet system for applying an oleophilic liquid to form an image on the hydrophilic aluminum surface of a lithographic plate. Ink jet technology, however, is in its infancy with respect to commercial lithography. Present ink jet techniques cannot produce large or commercially acceptable offset plates.

Lasers and their amenability to digital control have stimulated a substantial effort in the development of laser-based imaging systems. Early examples utilized lasers to etch away material from a plate blank to form an intaglio or letterpress pattern. See., e.g., U.S. Pat. Nos. 3,506,779: 4,347,785. This approach was later extended to production of lithographic plates, e.g., by removal of a hydrophilic surface to reveal an oleophilic underlayers. See, e.g., U.S. Pat. No. 4,054,094. These systems generally require high-power lasers which are expensive and slow.

A second approach to laser imaging involves the use of thermal-transfer materials as in U.S. Pat. Nos. 3,945,318: 3,962,513: 3,964,389: and 4,395,946. With these systems, a polymer sheet transparent to the radiation emitted by the laser is coated with a transferable material. During operation the transfer side of this construction is brought into contact with an acceptor sheet, and the transfer material is selectively irradiated through the transparent layer. Irradiation causes the transfer material to adhere preferentially to the acceptor sheet. The transfer and acceptor materials exhibit different affinities for fountain solution and/or ink, so that removal of the transparent layer together with unirradiated transfer material leaves a suitably imaged, finished plate. Typically, the transfer material is oleophilic and the acceptor material hydrophilic. Plates produced with transfer-type systems tend to exhibit short useful lifetimes due to the limited amount of material that can effectively be transferred. In addition, because the transfer process involves melting and resolidification of material, image quality tends to be visibly poorer than that obtainable with other methods.

Lasers have also be used to expose a photosensitive blank for traditional chemical processing as in U.S. Pat. Nos. 3,506,779: 4,020,762. In an alternative to this approach, a laser has been employed to selectively remove, in an imagewise pattern, an opaque coating that overlies a photosensitive plate blank. The plate is then exposed to a source of radiation with the unremoved material acting as a mask that prevents radiation from reaching underlying portions of the plate as in U.S. Pat. No. 4,132,168. Either of these imaging techniques requires the cumbersome chemical processing associated with traditional, non-digital platemaking.

U.S. Pat. Nos. 5,339,737, 5,353,705 and 5,351,617 also describe lithographic printing plates suitable for digitally controlled imaging by means of laser devices. Here, laser output ablates one or more plate layers, resulting in an imagewise pattern of features on the plate. Laser output passes through at least one discreet layer and imagewise ablates one or more underlying layer. The image features produced exhibit an affinity for ink or an ink-abhesive fluid the differs from that of unexposed areas. The ablatable material used in these patents to describe the image is deposited as an intractable, infusible, IR absorptive conductive polymer under an IR transparent polymer film. As a consequence, the process of preparing the plate is complicated and the image produced by the ablated polymer on the plate does not yield sharp and distinct printed copy.

It is an objective of the present invention to provide a lithographic plate suitable for image formation using a digitally controlled laser beam to ablate a conjugated polymer film.

A further objective of the invention is to provide a process for the production of the foregoing plate and film by in-situ polymerization of a suitable monomer on the plate to provide the ablatable coating.

SUMMARY OF THE INVENTION

Novel lithographic plate compositions and a method for their production have been discovered that are especially useful in conjunction with digitally controlled lasers to directly construct printable images on lithographic plates. The plates comprise a substrate and an ablatable conjugated polymeric coating on the substrate prepared from substituted or unsubstituted monomeric pyrrole, aniline or thiophene. The coating is prepared by in situ polymerization of the monomer as deposited on the plate by vapor deposition or polymerization in solution followed by substrate coating.

The ablatable coatings preferably contain IR absorbable polypyrrole or polypyrrole substituted with hydrophobic functional groups or with hydrophilic functional groups.. The effect is to optionally provide an oleophilic or hydrophilic ablatable coating on the substrate controlled by varying the nature of the substituent group on the monomeric pyrrole used to prepare the polypyrrole backbone.

More specifically, the invention comprises an infrared laser beam imageable lithographic printing plate comprising a substrate and a coating layer on the substrate wherein the coating layer comprises a polymeric composite of binder resin(s) and the polymeric residue produced by the in situ polymerization of one or more conjugated monomers. The monomers are polymerized in contact with catalyst and selected from the group consisting of substituted or unsubstituted pyrrole, aniline and thiophene alone or in admixture with binder(s). Preferably, the polymeric residue comprises a polyaniline, a polypyrrole or a polythiophene.

A method for the production of the infrared laser beam imageable lithographic printing plate consists of coating a substrate with a mixture of resin binder(s) and a catalyst suitable for polymerization of conjugated monomers selected from the group consisting of substituted or unsubstituted pyrrole, aniline and thiophene. The coating is contacted with vapor comprising one or more of the monomers under polymerization conditions. The vapor deposited monomers are polymerized in contact with catalyst for a time sufficient to form an ablatable polymeric composite coating.

DETAILED DESCRIPTION OF THE INVENTION

The lithographic plates of the instant invention consist of a substrate and a single coating on the substrate, preferably comprising a mixture of one or more binder resins and a laser ablatable polymer. The plates of the instant invention are distinguished over prior art plates containing ablatable coatings in that the plates of the instant invention employ only a single binder/polymer coating and the ablatable polymer is preferably formed by in situ polymerization of an appropriate monomer contained in the binder resin or by solution polymerization of the monomer followed by coating of the substrate. These differences over prior art plates are important determinants in the ability of the plate of the invention to form uniquely sharp features or images when a digitally controlled laser is caused to impinge on the coating. The consequent result is that hard copy printed from the plate is of excellent quality and the plate is capable of printing large numbers of copies of similar quality.

Substrates for the instant invention are preferably strong, stable and flexible, and may be a polymer film, or a paper or metal sheet. Polyester films such as MYLAR film sold by E. I. duPont de Nemours Co., is a useful examples. A preferred polyester-film thickness is 0.007 inch, but thinner and thicker versions can be used effectively. Aluminum is a preferred metal substrate. Paper substrates are typically "saturated" with polymerics to impart water resistance, dimensional stability and strength.

The present invention enables rapid, efficient production of lithographic printing plates using relatively inexpensive laser equipment that operates at low to moderate power levels. The imaging techniques described herein can be used in conjunction with a variety of plate-blank constructions, enabling production of "wet" plates that utilize fountain solution during printing or "dry" plates to which ink is applied directly.

The imaging apparatus of the present invention includes at least one laser device that emits in the IR, and preferably near-IR region: as used herein, "near-IR" means imaging radiation whose $lambda_{max}$ lies between 700 and 1500 nm. An important feature of the present invention is the use of solid-state lasers (commonly termed semiconductor lasers and typically based on gallium aluminum arsenide compounds) as sources; these are distinctly economical and convenient, and may be used in conjunction with a variety of imaging devices. The use of near-IR radiation facilitates use of a wide range of organic and inorganic absorption compounds and, in particular, semiconductive and conductive types.

Laser output can be provided directly to the plate surface via lenses or other beam-guiding components, or transmitted to the surface of a blank printing plate from a remotely sited laser using a fiber-optic cable.

The image signals are stored as a bitmap data file on a computer. Such files may be generated by a raster image processor (RIP) or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

Regardless of the manner in which the beam is scanned, it is generally preferable (for reasons of speed) to employ a plurality of lasers and guide their outputs to a single writing array. The writing array is then indexed, after completion of each pass across or along the plate, a distance determined by the number of beams emanating from the array, and by the desired resolution (i.e., the number of image points per unit length).

To be effective at all for lithographic plate image formation by laser ablation, polymers are limited to those that have physical properties sufficient to resist the wear encountered during the printing process and yet ablate to define a clear and sharp reproducible image. Regardless of how the polymer chemically ablates, a sharp image also requires a homogeneous distribution of the polymer throughout the coating to avoid irregularities and holidays in the ablated image. Unfortunately, polymers known in the prior art to be useful for ablatable coatings such as polypyrrole generally are infusible and intractable solids that do not readily lend themselves to the preparation of fully homogeneous coatings. The coating themselves are prepared in the prior art by mixing a solid, preformed polymer in the binder and coating that mixture on the substrate. This method does not function well to assure a homogeneous distribution of the ablatable polymer throughout the coating with the result that images produced by ablation are not distinct. Were it possible to avoid using a preformed, intractable ablatable polymer to prepare a coating, many of the flaws of prior art coatings would to eliminated.

Polypyrrole has a conjugated backbone and can occur in the neutral, radical cation and dication states. With these oxidation states, the polymer exhibits several strong absorption bands in the ultraviolet, visible and infrared regions. Polypyrrole can be obtained as a black powder by chemical polymerization of pyrrole using an oxidizing agent such as ferric chloride, hydrogen peroxide and ammonium persulfate in aqueous or organic media. The polymer can also be synthesized by electrochemical polymerization in aqueous and organic electrolytes containing the monomer. Polypyrrole is known as an insoluble and non-processable material. Coating of the polymer on a polyester substrate could be done using a preformed polymer dispersion. However, polymer films obtained from such coating techniques do not have good mechanical properties and adhere poorly to the substrate. As a result, the printing plates have relatively short impression life.

Ablatable polymers can be formed as coatings on lithographic plate substrates by the processes of the instant invention by in-situ vapor polymerization or solution polymerization of a suitable monomer alone or in a resin binder. Two means have been discovered to provide polymerizable monomer/binder systems on a substrate: vapor deposition of a monomer onto the binder coating in contact with catalyst or treating or coating of the substrate with a mixture comprising preformed polymer binder, ablatable polymer and solvent. The infrared absorbing polymers and the polymeric binders can undergo ionic and/or covalent cross-linking during polymerization or after coating on the plate substrate.

In addition to unsubstituted or substituted polypyrrole, other substituted or unsubstituted polymers are useful as ablatable systems for lithographic plates, including polyanilines and polythiophenes. A description of these polymers is to be found in "Physical Electrochemistry: Principle, Method and Applications", Chapter 12 (Electronically Conducting Soluble Polymers), a monograph edited by Israel Rubinstein, published by Marcel Decker, 1995; and in "Conjugated Poly(thiophenes): Synthesis, Functionalization and Applications" by Jean Roncali, Chem. Rev. 1992, 92, 711–738.

I. Solution Polymerization

One process of the invention relates to the synthesis of polymeric solutions as coatings for laser imageable lithographic printing plates. The polymeric solutions consist of at least one ablatable infrared absorbing polymer, polymeric binders, coupling agents, terminating agents and organic or aqueous solvents. More specifically, the infrared absorbing polymer is obtained as a colloid form having a particle size around $10^{-9}$ meters by the chemically catalyzed polymerization of the corresponding monomer in organic or aqueous solutions containing polymeric binders and coupling agents. During polymerization, the infrared absorbing polymer is formed and undergoes cross-linking with the polymeric binders to form a stable homogenous solution. Chain terminating agents are also added to the reaction mixture to terminate the polymerization. The solution is then coated on the plate substrate by spin or bar coating techniques. Upon drying, the infrared absorbing polymer undergoes further polymerization and cross-linking with the polymeric binders to form uniform polymeric films which exhibit good mechanical and adhesive properties. Furthermore, the obtained films are easily ablated upon exposure to the infrared laser light to give a clean image.

The infrared absorbing polymers described are obtained by polymerization of aromatic compounds such as pyrrole, aniline, thiophene, indole and their substituted derivatives, wherein the substituent groups include alkyl, aryl, alkene, hydroxy alkyl, alkyl halide, trialkoxy silyl, carboxylate and sulfonate. The polymeric binders are hydrocarbon or organosilicon oligomers and/or polymers, preferably containing one of the following reactive functional group (i.e., hydroxy, urethane, maleic anhydride, silyl hydride, acrylate and nitrocellulose). Optionally, the binders are selected from those oligomers or polymers that are thermally cross-linkable with the infrared absorbing polymers; however, it is not required that the binders form crosslinks with the ablatable conjugated polymer. Generally, better physical properties for the product are realized when cross-linking is accomplished. The coupling agents are at least one of the following compounds: ferric chloride, hydrogen peroxide, benzoyl peroxide, ammonium persulfate, copper perchlorate, platinic chloride, platinum-divinyltetramethyldisiloxane, zinc dioctoate and dibutyltin-diacetate. The terminating agents are the monomer derivatives having one substitutent at the polymerizing position (i.e., 2-alkyl pyrrole, 4-alkyl aniline, 2-alkyl thiophene and 2-alkyl indole).

When a substituted pyrrole is used as monomer and the substituted pyrrole is a solid, the solution polymerization method can be modified to dissolve the binder resin and the monomer in the solution and coated on the metal or polymer substrate. The coated substrate is then immersed in an aqueous or organic solution containing an oxidizing agent. The substituted pyrrole monomer in the binder resin undergoes polymerization to form a uniform and adherent polymeric film.

a. Polypyrroles

The following Examples 1 to 5 describe the syntheses of polymeric solutions containing infrared absorbing polymers which were obtained by the polymerization of pyrrole, N-methyl pyrrole, N-ethyl pyrrole, 1-(trimethoxy silyl propyl) pyrrole and 3-n-octyl pyrrole wherein ferric chloride is employed as an oxidative coupling agent. Example number 6 is a control experiment. During polymerization, infrared absorbing polymers were formed and undergo ionically cross-linking with the polymeric binders during polymerization to produce stable polymeric solutions. The polymeric solutions were prepared as followings:

| Component | Examples 1 | 2 | 3 | 4 | 5 | 6 |
|---|---|---|---|---|---|---|
| | Parts | | | | | |
| Solvent mixture | 100 | 100 | 100 | 100 | 100 | 100 |
| Nitrocellulose | 5 | 5 | 5 | 5 | 5 | 0 |
| Scripset 810 | 5 | 5 | 5 | 5 | 5 | 0 |
| Ferric chloride | 4 | 4 | 4 | 4 | 2 | 4 |
| Pyrrole | 10 | — | — | 8 | — | 10 |
| N-methyl pyrrole | — | 10 | — | — | — | — |
| N-ethyl pyrrole | — | — | 10 | — | — | — |
| N-Trimethoxy silyl propyl pyrrole | — | — | — | 2 | — | — |
| 3-octyl pyrrole | — | — | — | — | 10 | — |

Nitrocellulose was obtained from Hercules. Scrip set 810 resin is styrene-maleic anhydride copolymer (Monsanto). These polymeric binders were dissolved in the solvent mixture which contains 30% methyl cellosolve, 20% methanol, 28% dioxalane, 1% N,N'-dimethyl formamide, 21% methyl ethyl ketone. Anhydrous ferric chloride was added into the solution in small portions to avoid a violent reaction which produced a white fume of hydrochloric acid. After stirring for 30 minutes at room temperature, the solution was filtered to remove the solid residue. Monomer was then added in one portion and the reaction mixture was stirred at room temperature for 4 hours. The reaction mixture was filtered and was coated on the DS and EG aluminum substrates at 60° C. to produce uniform black films. These coated films were easily ablated upon exposure to an infrared laser light at 875 nm to produce a clean image.

b. Polyanilines

The following Examples 7–11 describe the syntheses of polymeric solutions containing infrared absorbing polymers which were obtained by the polymerization of aniline, N-methyl aniline, N-n-butyl aniline, 2-methyl aniline and 2-amino benzyl alcohol using n-dodecylbenzyl sulfonic acid (DBSA) and benzoyl peroxide as counter ion and oxidative agent, respectively. The polymeric solutions were prepared as followings: aniline, N-methyl aniline, 2-methyl aniline, 2-amino benzyl alcohol and benzoyl peroxide were purchased from Aldrich Chemical. N-n-butyl aniline was obtained from TCI-America. Dodecyl benzyl sulfonic acid was obtained from Browning. Acryloid A21 is an acrylate polymer which was obtained from Rohm & Haas. The binder resin was dissolved in toluene. Monomer, dodecyl benzyl sulfonic acid and benzoyl peroxide were added. The reaction mixture was heated to 60° C. under constant stirring under a nitrogen atmosphere for 4 hours. The reaction mixture was filtered through 1.0 $\mu$m filter paper. The polymeric solution was coated on the smooth or grain aluminum substrate at 60° C. and dried using hot air to produce uniform dark green films. These coated films were easily ablated upon exposure to an infrared laser light at 875 nm to produce a clean image.

| Component | Examples 7 | 8 | 9 | 10 | 11 |
|---|---|---|---|---|---|
| | Parts by weight | | | | |
| Toluene | 100 | 100 | 100 | 100 | 100 |
| Acryloid A-21 | 10 | 10 | 10 | 10 | 10 |
| DBSA | 13 | 13 | 13 | 13 | 13 |
| Benzoyl peroxide | 9 | 9 | 9 | 9 | 9 |
| Aniline | 3.8 | — | — | — | — |
| N-methyl aniline | — | 4.3 | — | — | — |

-continued

| Component | Examples 7 | 8 | 9 | 10 | 11 |
|---|---|---|---|---|---|
| | Parts by weight | | | | |
| N-butyl aniline | — | — | 6.0 | — | — |
| 2-methyl aniline | — | — | — | 4.3 | — |
| 2-amino benzyl alcohol | — | — | — | — | 4.9 |

c. Polythiophenes

The following Examples 12–14 describe the syntheses of polymeric solutions containing infrared absorbing polymers which were obtained by the polymerization of thiophene, 3-hexyl thiophene and 3-octyl thiophene using ferric chloride as an oxidative agent. The polymeric solutions were prepared as followings:

Thiophene, 3-hexyl thiophene and 3-octyl thiophene were obtained from TCI America. The polymer binder was dissolved in the chloroform and methyl ethyl ketone mixture. Anhydrous ferric chloride was slowly added into the reaction. After stirring for one hour at room temperature, the solution was filtered to remove the solid residue. Monomer was then added in one portion and the reaction mixture was stirred at room temperature for 5 hours under nitrogen atmosphere. The reaction mixture was filtered and then coated on the smooth or grain aluminum substrate at 60° C. to produce uniform dark blue-green films. The coated films were easily ablated upon exposure to an infrared laser light at 875 nm to produce a clean image.

| Component | Examples 12 | 13 | 14 |
|---|---|---|---|
| | Parts by weight | | |
| Chloroform | 80 | 80 | 80 |
| methyl ethyl ketone | 20 | 20 | 20 |
| Acryloid A-21 | 10 | 10 | 10 |
| Ferric chloride | 4 | 4 | 4 |
| Thiophene | 10 | — | — |
| 3-hexyl thiophene | — | 10 | — |
| 3-octyl thiophene | — | — | 10 |

II. In-situ Vapor Polymerization

In-situ vapor polymerization of ablatable monomers can be carried out using substituted or unsubstituted pyrrole, aniline or thiophene monomers. However, pyrrole is the preferred monomer for in-situ vapor polymerization. The polymeric composites containing polypyrrole and its substituted derivatives on either metal or polymer substrate are obtained by in-situ chemical polymerization of the monomers as deposited by vapor. The monomer may be deposited on a substrate which has been coated with an oxidative agent such as ferric chloride or, preferably, the substrate is first coated with a binder resin containing the oxidative agent. The preferred method, i.e., precoating with binder resin, provides an ablated film that has better adhesion to the substrate and superior physical properties commensurate with longer useful life during subsequent printing operations.

Specifically, a smooth aluminum substrate is coated with a solution containing binder resin, e.g., nitrocellulose, polyurethane, polycarbonate, polyepoxide, polystyrene, polysiloxane and polyvinyl alcohol, alone or in combination; and oxidizing agent, e.g., ferric chloride, hydrogen peroxide and ammonium persulfate, alone or in combination. The coated substrate is then placed in contact with the monomer vapor which undergoes polymerization to form a uniform film. The rate of polymerization is controlled by varying the temperature and concentration of the oxidizing agent in the binder.

The following Examples 15 and 16 are illustrative of the instant process for in-situ vapor polymerization.

EXAMPLE 15

Polypyrrole-Nitrocellulose Composites

Nitrocellulose polymer (1.0 g)-and anhydrous ferric chloride (0.1 g) were dissolved in 6.0 g of a solvent mixture containing methyl cellulose (30%), methanol (20%), dioxalane (28%) and dimethyl formamide (21%). The polymeric solution was coated on a smooth aluminum substrate using a wire-wound rod and dried to produce a uniform coating deposited at about 1 gram per meter. The coated aluminum substrate is then place in contact with pyrrole vapor at room temperature. A uniform black film of polypyrrole-nitrocellulose composite was obtained in 10 mins. The contact angle of a drop water on the film surface was measured to be 71. A contact angle 40–110 is desirable depending on the application. A contact angle between 40–90 is desirable for a wet plate, i.e, a plate requiring fountain solution. A contact angle between 90–110 is desirable for a waterless plate where no water is required.

Upon exposure to laser light with the wavelength in the infrared region, the polypyrrole-nitrocellulose composite film was rapidly ablated and produced a clean image.

EXAMPLE 16

Poly(N-methyl pyrrole)-Nitrocellulose Composite

A uniform film of poly(N-methyl pyrrole)-nitrocellulose composites on a smooth aluminum substrate was prepared in the same procedure as in Example 15. N-methyl pyrrole was used instead of pyrrole as the monomer. The contact angle with water was 86. This indicates that poly(N-methyl pyrrole)-nitrocellulose is more hydrophobic than polypyrrole-nitrocellulose composites.

EXAMPLE 17

Poly(N-ethyl pyrrole)-Nitrocellulose Composites

An uniform film of poly(N-ethyl pyrrole)-nitrocellulose composite on a smooth aluminum substrate was prepared in the same procedure as in Example 16. N-ethyl pyrrole was used instead of N-methyl pyrrole as the monomer. The contact angle with water was 89°. This indicates that poly (N-ethyl pyrrole)-nitrocellulose is more hydrophobic than poly(pyrrole)nitrocellulose and poly(N-methyl pyrrole)-nitrocellulose composites.

Upon exposure to laser light with the wavelength in the infrared region, the polypyrrole-nitrocellulose composite films were rapidly ablated and produced clean images.

III. Ablatable coatings without Binder Resin

As stated herein before, useful ablatable coatings for lithographic plate production can be formed without the use of a binder resin serving to augment adhesive properties or other physical properties that reinforce the endurance of the printable image. Ablatable coating without binder resins can be prepared by solution polymerization of the IR absorbing monomer followed by coating of the substrate or, when the monomer is readily vaporizable, the monomer can be vapor deposited on a substrate surface coated with an oxidative agent and polymerized in situ. Generally, the method of formation of an ablatable coating without binder follows the procedure described above for solution or in situ polymerization of monomers in conjunction with binder.

The following non-limiting Examples 18–23 are provided to illustrate the formation of IR ablatable coatings on lithographic plate substrate without employing a resin binder. The Examples show that the three general classes of ablatable coatings, i.e., polyanilines, polythiophenes and polypyrroles described herein before, can be converted to useful coatings without resorting to polymeric binder or other films supports in a composite system.

EXAMPLE 18

Synthesis of poly(2-methyl aniline)

Poly(2-methyl aniline) [Aldrich Chemical] was synthesized by slowly adding 100 ml of 1 M aqueous HCl solution containing 6.7 g of ammonium bisulfate into 150 ml of 1 M aqueous HCl solution and dissolving therein 11.7 g of 2-methyl aniline with constant stirring between 0 and 5° C. A dark green color developed immediately and the polymer was eventually precipitated out of the solution. The reaction was stirred between 0 and 5° C. for an additional 12 hours. The reaction mixture was filtered and the polymer precipitate was washed with water until the filtrate became colorless. The wet poly(2-methyl aniline) powder was then suspended with constant stirring in 250 ml of 0.1 M $NH_4OH$ solution for 15 hours. The polymer product was collected by filtration, washed with water until the filtrate became neutral, and then dried under vacuum until constant weight was achieved.

The coating solution was prepared by dissolving 1.0 g of poly(2-methyl aniline) in 10 ml of tetrahydrofuran. The polymeric solution was filtered to remove the solid residue. The solution was coated on the grain aluminum substrate plate to produce a dark blue uniform film. The films were dipped in 1 M HCl solution which changed to dark green color. After drying in air, the films were easily ablated upon exposure to infrared laser light at 875 nm to produce a clean image.

EXAMPLE 19

Water soluble poly(aniline-co-N-(4-sulfophenyl) aniline)

Poly(aniline-co-N-(4-sulfophenyl)aniline) copolymer was synthesized by slowly adding 50 ml of 1.2 M HCl containing 6.8 g of ammonium persulfate into 50 ml of 1.2 M HCl solution and dissolving therein 0.93 g of aniline [Aldrich Chemical] and 2.7 g of diphenylamine-4-sulfonic acid sodium salt [Aldrich Chemical] with constant stirring at room temperature. A dark green color developed immediately, and the polymer eventually precipitated out of the solution. The reaction mixture was stirred for additional 20 hours at room temperature. The reaction mixture was then centrifuged and the recovered dark green precipitate was washed 10–12 times with 1.2 M HCl. The polymer powder was then isolated as a powder and dried to constant weight in vacuum at 20° C.

The coating solution was prepared by dissolving 0.5 g poly(aniline-co-N-(4-sulfophenyl)aniline) powder in 5 ml of 1.0 M aqueous $NH_4OH$. The polymeric solution was filtered to remove the solid residue. The filtered solution was coated on the grain aluminum substrate and dried using hot air to produce dark green uniform films. These films were easily ablated upon exposure to infrared laser light at 875 nm to produce a clean image.

EXAMPLE 20

Poly(3-octyl pyrrole)

Poly(3-octyl pyrrole) was synthesized by slowly adding to 20 ml of water 3.2 g of anhydrous ferric chloride into 20 ml water/acetonitrile mixture (80/20 by volume) and 0.9 g of 3-octyl pyrrole under constant stirring at room temperature. A black color developed immediately and the polymer was eventually precipitated out of the solution. The reaction was stirred at room temperature for an additional 4 hours. The reaction mixture was filtered and washed with a large amount of methanol. The black poly(3-octyl pyrrole) powder was then dried in vacuum at 20° C. until constant weight was achieved.

The coating solution was prepared by dissolving 0.5 g poly(3-octyl pyrrole) with 10 ml tetrahydrofuran. The polymeric solution was filtered to remove the solid residue. The filtered solution was coated on the grain aluminum substrate to produce black uniform films. These films were easily ablated upon exposure to infrared laser light at 875 nm to produce a clean image.

EXAMPLE 21

Synthesis of poly(3-octyl thiophene)

Poly(3-octyl thiophene) was synthesized by slowly adding 20 ml chloroform/methyl ethyl ketone mixture (80/20 by volume) containing 3.6 g anhydrous ferric chloride into 20 ml chloroform solution dissolving therein 1.0 g 3-octyl thiophene [TCI-America] with constant stirring at room temperature. A dark red color developed immediately and eventually changed to dark blue. The reaction mixture was stirred at room temperature for an additional 12 hours. The reaction mixture was filtered and washed with a large amount of methanol. Then, the poly(3-octyl thiophene) precipitate was suspended with constant stirring in 100 ml of methanol for 10 hours. The polymer powder was collected by filtration and dried in vacuum until constant weight was achieved.

The coating solution was prepared by dissolving 0.5 g poly(3-octyl thiophene) with 10 ml tetrahydrofuran. The polymeric solution was filtered to remove the solid residue. The filtered solution was coated on the grain aluminum substrate to produce red-brown uniform films. These films were dipped in water solution containing 0.1 M ferric chloride which changed to dark green color. After drying in air, these films were easily ablated upon exposure to infrared laser light at 875 mn to produce a clean image.

EXAMPLE 22

In Situ Vapor Polymerization of Pyrrole 1.0 g of ferric chloride was slowly dissolved into 10 g of methyl ethyl ketone. The solution was filtered to remove the solid residue. The filtrate was coated on the grain aluminum substrate using a number 3 wire-round rod then dried under hot air. The coated aluminum was placed in contact with the pyrrole vapor at room temperature. A black powder film was formed in a few seconds. Upon exposure to infrared laser light at 875 nm, the polypyrrole film was ablated to produce a printing image.

EXAMPLE 23

In-Situ Polymerization of N-Methyl Pyrrole

The in-situ polymerization of N-methyl pyrrole was preformed similar to the above Example 22. The black poly (N-methyl pyrrole) was ablated upon exposure to infrared laser light at 875 nm to produce a printing image.

Regardless of the method of formation of the ablatable film as described herein, i.e., by solution polymerization followed by coating of the substrate or in situ polymerization on the substrate the monomer employed may be unsubstituted or carry the following substituents groups:

i. substituted aniline substitution at nitrogen atom: alkyl, allyl, benzyl, phenyl, 2-methylphenyl, 3-methylphenyl, 3-methoxyphenyl, 3-chlorophenyl, 4-sulfophenyl and 3-(trialkoxysilyl)propyl;

mono-substitution on the aromatic ring at the ortho and meta positions: methyl, ethyl, propyl, methoxy, hydroxy methyl, chloride, iodide, sulfonic acid and carboxylic acid;

di-substitution on the aromatic ring: 2,5-dimethyl and 3,6-dimethyl;

ii. substituted pyrrole substitution at the nitrogen atom: alkyl, allyl, benzyl, oxyalkyl, alkyl sulfonic acid and alkyl carboxylic acid;

mono-substitution either at the 3 or 4 position: alkyl, halide, alkoxy, ether, polyether, fluorinated alkyl, sulfonic acid and carboxylic acid;

di-substitution at 3 and 4 positions: dialkyl and dioxyalkyl;

iii. substituted thiophene mono-substitution at either 3 or 4 position: alkyl, fluorinated alkyl, aryl, halide, alkoxy, ether, polyether, sulfonic acid and alkyl sulfonic acid;

di-substitution at 3 and 4 positions: dialkyl, alkyl & alkoxy, dialkoxy, alkyl & halide, alkyl & ether and alkyl & polyether.

Binders that may be used for the ablatable coatings of the invention are selected from the group consisting of cellulose esters, polyesters, polyurethanes, polyethers, polyamides, polysulfides, polysiloxanes, vinyl polymers, polyvinylalcohol, polyvinylpyrrolidone and polyolefins.

What is claimed is:

1. An element imageable with a digitally controlled infrared laser beam to form a lithographic printing plate, said element comprising a lithographic plate substrate and an infra-red ablatable coating layer on said substrate, wherein said coating layer comprises a polymeric composite of at least one binder resin and at least one ablatable infra-red absorbing polymer selected from the group consisting of a polypyrrole, a polyaniline and a polythiophene, wherein said coating layer has a water contact angle between 40 and 110 degrees.

2. The element of claim 1 wherein said binder resin is selected from the group consisting of cellulose esters, polyesters, polyurethanes, polyethers, polyamides, polysulfides, polysiloxanes, vinyl polymers, polyvinyl alcohol, polyvinylpyrrolidone and polyolefins.

3. The element of claim 1 wherein said binder resin contains a reactive functional group and said polymeric composite comprises a crosslinked polymeric composite.

4. The element of claim 3 wherein said functional group is selected from the group consisting of hydroxy, urethane, maleic anhydride, silyl hydride, acrylate and nitrocellulose.

5. The element of claim 1 wherein said polymer contains at least one substituent group selected from the group consisting of halide, alkyl, aryl, alkaryl, acyl, alkenyl, allyl, alkoxy, aryloxy, hydroxyalkyl, halogenated alkyl trialkoxysilylalkyl, alkylsulfonic acid, polyether and alkylcarboxylic acid.

6. The element of claim 1 wherein said polymer comprises a poly-N-methylpyrrole.

7. The element of claim 1 wherein said water contact angle is between 40 and 90 degrees.

8. The element of claim 1 wherein said water contact angle is between 90 and 110 degrees.

9. The element of claim 1 wherein the lithographic plate substrate is an aluminum substrate.

10. An element imageable with a digitally controlled infrared laser beam to form a lithographic printing plate, said element comprising a lithographic plate substrate and an infra-red ablatable coating layer on said substrate, wherein said coating layer comprises at least one ablatable infra-red absorbing polymer selected from the group consisting of a polypyrrole, a polyaniline and a polythiophene, wherein said coating layer has a water contact angle between 40 and 110 degrees.

11. The element of claim 10 wherein said polymer contains at least one substituent group selected from the group consisting of halide, alkyl, aryl, alkaryl, acyl, alkenyl, allyl, alkoxy, aryloxy, hydroxyalkyl, halogenated alkyl, trialkoxysilylalkyl, alkylsulfonic acid, polyether and alkylcarboxylic acid.

12. The element of claim 10 wherein the lithographic plate substrate is an aluminum substrate.

13. A method for producing an element imageable with an infrared laser beam to form a lithographic printing plate, said method comprising:

coating a lithographic plate substrate with a mixture of at least one binder resin and a catalyst suitable for polymerization of at least one conjugated monomer selected from the group consisting of a pyrrole, an aniline and a thiophene to form a coated substrate;

contacting said coated substrate with said monomer under polymerization conditions; and polymerizing said monomers in contact with said coated substrate for a time sufficient to form an ablatable polymeric composite coating on said lithographic plate substrate, wherein said abatable coating has a water contact angle between 40 and 110 degrees.

14. The method of claim 13 wherein said polymerization conditions comprises a temperature between 10° C. and 150° C. and said time is between 10 seconds and one hour.

15. The method of claim 13 wherein said catalyst comprises an inorganic or an organic oxidizing agent.

16. The method of claim 15 wherein said oxidizing agent is ferric chloride.

17. The method of claim 13 wherein said binder resin is selected from the group consisting of cellulose esters, polyesters, polyurethanes, polyethers, polyamides, polysulfides, polysiloxanes, vinyl polymers, polyvinyl alcohol, polyvinylpyrrolidone and polyolefins.

18. A method for producing an element imageable with an infrared laser beam to form a lithographic printing plate, said method comprising:

introducing at least one conjugated monomer selected from the group consisting of a pyrrole, an aniline and a thiophene into an organic solvent containing at least one resin binder and a catalyst suitable for polymerization of said conjugated monomer;

reacting said monomer under polymerization conditions to provide a mixture containing a polymeric composite; and coating a lithographic plate substrate with said mixture to provide an infrared radiation ablatable polymeric composite coating, wherein said abatable coating has a water contact angle between 40 and 110 degrees.

19. The method of claim 18 wherein said catalyst comprises an inorganic or organic oxidizing agent and said binder is selected from the group consisting of cellulose esters, polyesters, polyurethanes, polyethers, polyamides, polysulfides, polysiloxanes, vinyl polymers, polyvinyl alcohol, polyvinylpyrrolidone and polyolefins.

20. A method of forming a lithographic printing plate, said method comprising:

providing an element comprising a substrate and an infra-red ablatable coating layer on said substrate, wherein said coating layer comprises at least one ablatable infra-red absorbing polymer selected from the group consisting of a polypyrrole, a polyaniline and a polythiophene; and imagewise exposing the coating layer to infrared laser radiation to ablate selected areas of the coating layer to uncover underlying plate surface areas to form the lithographic printing plate having said plate surface areas and complimentary unexposed coating surface areas; and then applying an ink to either said plate surface areas or said coating surface areas.

21. The method of claim 20 wherein said substrate is aluminum and said coating surface areas are receptive to the applied ink.

22. The method of claim 20 wherein said plate surface areas are receptive to the applied ink.

* * * * *